US009863619B2

(12) United States Patent
Mak

(10) Patent No.: US 9,863,619 B2
(45) Date of Patent: Jan. 9, 2018

(54) LAMP, TRANSITION MEMBER FOR MOUNTING LAMP, LAMP BODY AND JUNCTION BOX ASSEMBLY

(71) Applicant: Smart Hero Enterprises Limited, Kwai Chung Nt (CN)

(72) Inventor: Wilson Yu Sang Mak, Kwait Chung NT (CN)

(73) Assignee: Smart Hero Enterprises Limited, Kwai Chung NT (CN)

( * ) Notice: Subject to any disclaimer, the term of this patent is extended or adjusted under 35 U.S.C. 154(b) by 0 days.

(21) Appl. No.: 15/358,035

(22) Filed: Nov. 21, 2016

(65) Prior Publication Data

US 2017/0299164 A1 Oct. 19, 2017

(30) Foreign Application Priority Data

Apr. 15, 2016 (CN) ..... 2016 1 0233628

(51) Int. Cl.

| | |
|---|---|
| ***F21V 23/02*** | (2006.01) |
| ***F21S 8/00*** | (2006.01) |
| ***F21V 23/00*** | (2015.01) |
| ***F21V 21/08*** | (2006.01) |

(52) U.S. Cl.

CPC ..... *F21V 23/002* (2013.01); *F21S 8/036* (2013.01); *F21V 21/0832* (2013.01); *F21V 23/02* (2013.01)

(58) Field of Classification Search

CPC .... F21S 8/03; F21S 8/033; F21S 8/036; F21S 8/04; F21S 8/043; F21V 23/02; F21V 23/023

See application file for complete search history.

(56) References Cited

U.S. PATENT DOCUMENTS

| | | | | | |
|---|---|---|---|---|---|
| 2,532,528 | A * | 12/1950 | Zuley | F21V 21/112 | 248/343 |
| 2,569,859 | A * | 10/1951 | Locke | F21V 21/025 | 248/339 |
| 4,162,779 | A * | 7/1979 | Van Steenhoven | F21V 21/03 | 248/343 |
| 6,905,222 | B1 * | 6/2005 | Russello | F21S 8/033 | 362/147 |
| 7,658,517 | B2 * | 2/2010 | Czech | F21S 8/02 | 220/3.8 |
| 2007/0029456 | A1 * | 2/2007 | Mier-Langner | F21S 8/038 | 248/342 |
| 2010/0091503 | A1 * | 4/2010 | Kuo | F21S 8/04 | 362/362 |

* cited by examiner

*Primary Examiner* — Mariceli Santiago
(74) *Attorney, Agent, or Firm* — Wang Law Firm, Inc.

(57) ABSTRACT

The present application relates to a lighting device and in particular to a lamp, a transition member for mounting a lamp, a lamp body and a junction box assembly, by which problems such as inconvenient operation and low efficiency in connecting wires during the mounting of a lamp can be solved. The lamp provided by the present application comprises a lamp body and a transition member which is configured to mount the lamp body in a mounting position. The transition member comprises a mounting portion and a placement portion; the mounting portion is configured to be mounted in said mounting position; and the placement portion enables the lamp body to be placed thereon before the mounting is completed, and in this state, wires connected between the lamp body and the mounting position are not shielded so that it is possible to connect the wires.

11 Claims, 6 Drawing Sheets

LAMP, TRANSITION MEMBER FOR MOUNTING LAMP, LAMP BODY AND JUNCTION BOX ASSEMBLY

TECHNICAL FIELD

The present application relates to a lighting device and in particular to a lamp, and a transition member for mounting a lamp, a lamp body and a junction box assembly.

BACKGROUND ART

Some lamps include two parts: a lamp body and a junction box; wires are connected to the lamp body; and it is desired to connect the wires into the junction box. An induction lamp is mounted by, firstly, fixedly mounting the junction box, then connecting the wires into the junction box, and finally mounting the lamp body on the junction box. An induction lamp is usually mounted on a wall or roof in a high position. In the prior art, when mounting an induction lamp, it is desired to mount the induction lamp in a high position and there is no place to put the lamp body, such that the mounting personnel have to hold the lamp body with one hand, only the other hand could be free to connect the wires. Sometimes, even have to connect the wires with both hands while clamping the lamp body with their arms and body. It is quite inconvenient and inefficient to mount an induction lamp.

SUMMARY

An objective of the present application is to make the connection of wires during the mounting of a lamp safe and convenient.

To achieve this, a lamp is provided, including: a lamp body and a transition member which is configured to mount the lamp body in a mounting position. The transition member includes a mounting portion and a placement portion which are connected together; the mounting portion is configured to be mounted in said mounting position; and the placement portion enables the lamp body to be placed thereon before the mounting is completed, and in this state, wires connected between the lamp body and the mounting position are not shielded so that it is possible to connect the wires.

Specifically, the placement portion is provided with a hook by which the lamp body is hooked before the mounting is completed; and the lamp body is provided with a hooked portion which is hooked by the hook.

Specifically, the lamp body can, when hooked, be rotated to the mounting position. Whereby, the lamp can be directly rotated to the mounting position after connecting the wires, so that it is efficient to conduct the following mounting.

Specifically, the lamp includes a junction box; and the lamp body is arranged on the junction box, that is, a corresponding position on the junction box is said mounting position.

The transition member for mounting a lamp provided by the present application is the transition member in the above-mentioned lamp.

The lamp body provided by the present application is the lamp body in the above-mentioned lamp.

The junction box assembly provided by the present application includes the junction box and the transition member in the above-mentioned lamp.

The mounting process of the lamp is as follows: the mounting portion is mounted in a mounting position, the lamp body is placed on the placement portion, and the wires connected between the lamp body and the mounting position are not shielded, so that the mounting personnel can connect the wires by both hands. The present application has the following beneficial effect: compared with the prior art, the transition member for mounting a lamp provided by the present application is more convenient for the mounting personnel to mount a lamp and improves the efficiency.

BRIEF DESCRIPTION OF DRAWINGS

FIG. 6 is a view of the state in which the lamp has been mounted, in which:

1: junction box;
2: screw;
3: transition member;
31: mounting portion;
311: claw portion;
32: placement portion;
321: guide ring;
322: notch;
323: hook;
4: lamp body; and
41: cross beam.

DETAILED DESCRIPTION

The present application will be further described in connection with the following embodiments.

Figure 6:
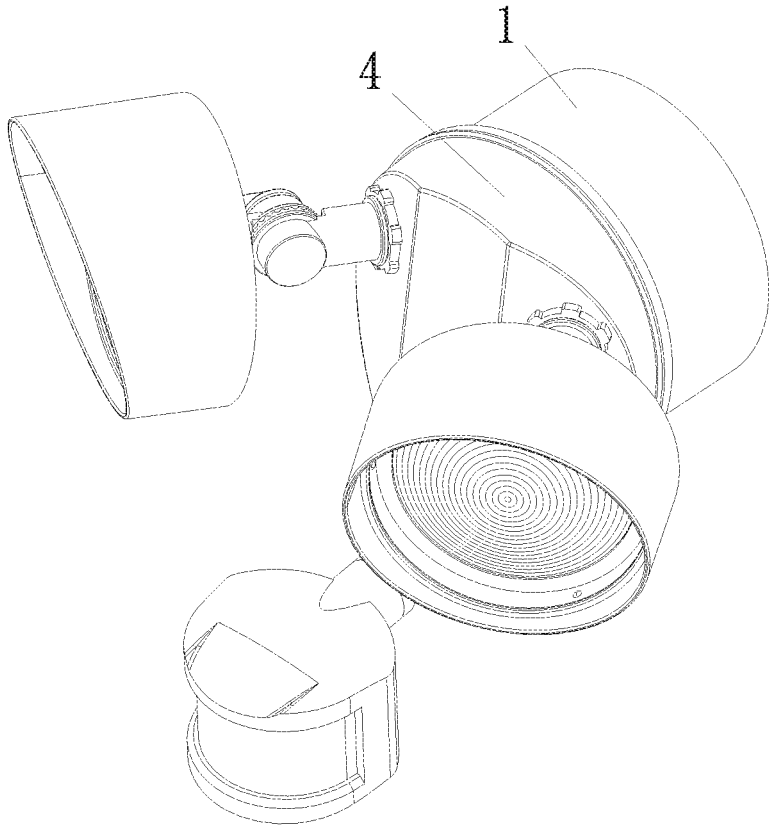

FIG. 6 shows a state in which the lamp according to the embodiment has been mounted. The similarity between such state and the prior art is that the wires (not shown) connected between a lamp body 4 and a junction box 1 are shielded. This beautifies the lamp, but for a lamp in this state, the wires cannot be connected. When mounting the lamp according to the embodiment, the lamp body 4 can be placed temporarily on a transition member 3, so that the mounting personnel can connect the leads by both hands. The specific operations are as described below.

Figure 1:
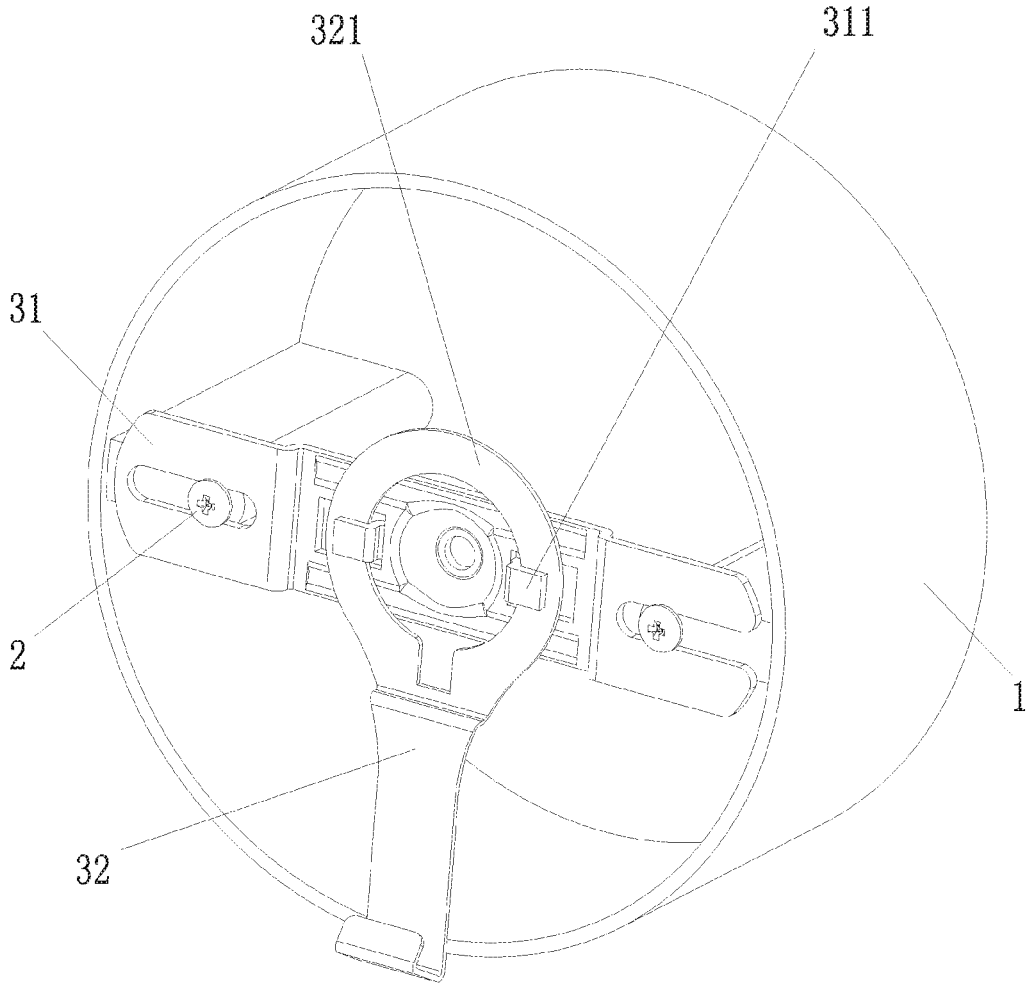
FIG. 1 is a stereoscopic view of a junction box assembly.
Figure 2:
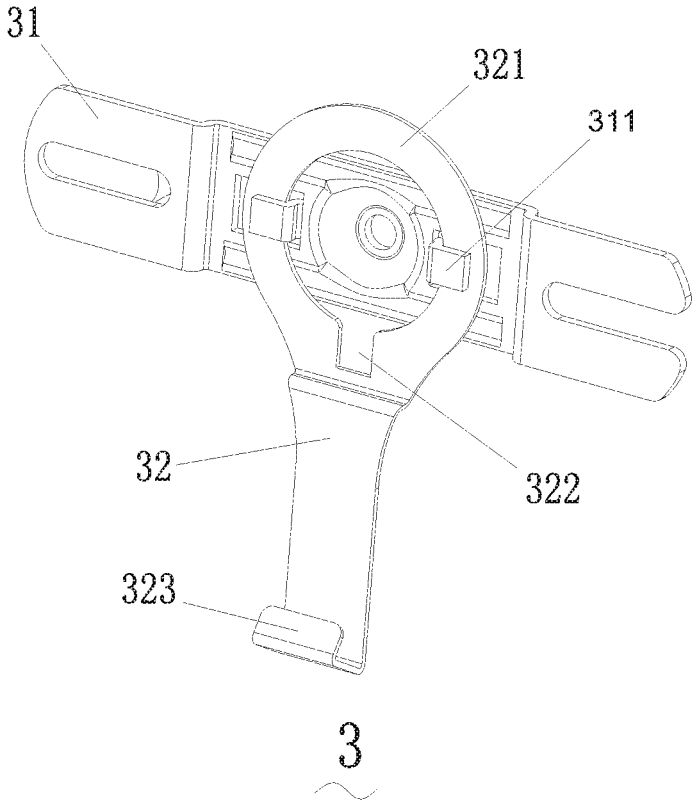
FIG. 2 is a stereoscopic view of a transition member.

A junction box assembly of the lamp according to the embodiment, as shown in FIG. 1, includes a junction box 1 and a transition member 3 as shown in FIG. 2; the transition member 3 includes a mounting portion 31 and a placement portion 32; and the mounting portion 31 is provided with two claw portions 311, one claw portion 311 and the body of the mounting portion 31 form one segment of the guide groove together, and the two claw portions 311 form two segments of the guide groove.

Figure 3:
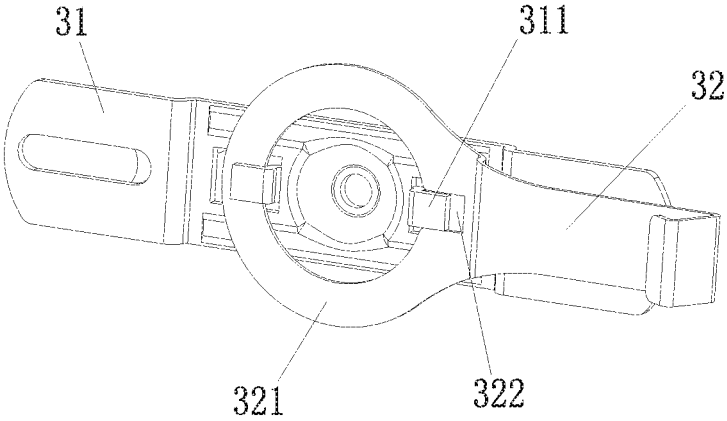
FIG. 3 is a view of the state in which the notch is aligned to the claw portion.
Figure 4:
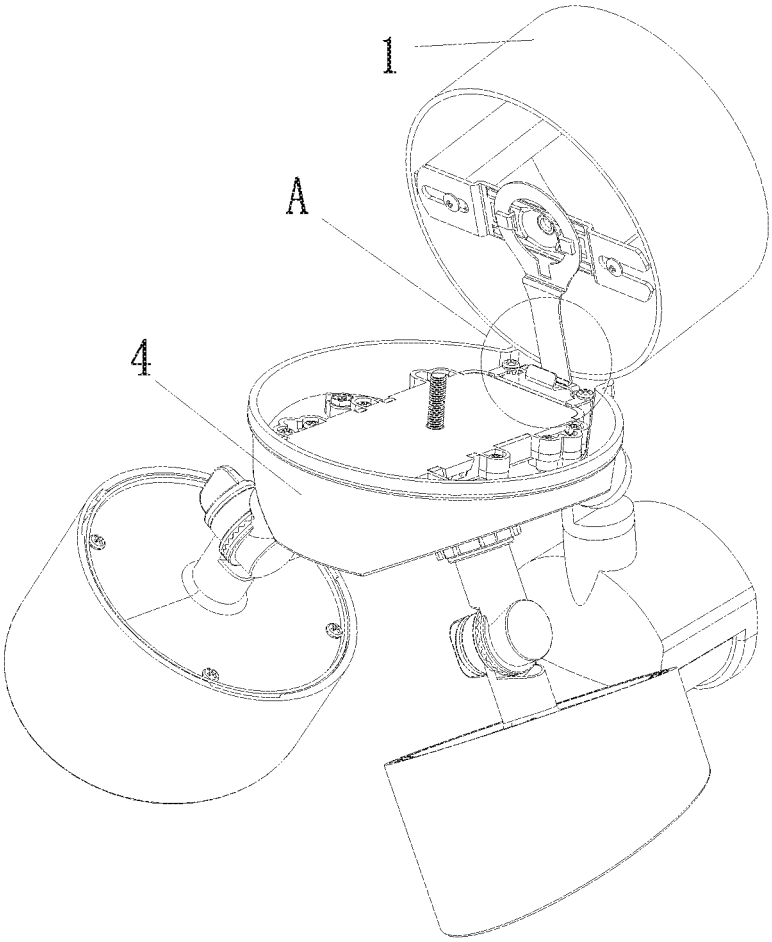
FIG. 4 is a view of the state in which the lamp body is hooked by the hook.
Figure 5:
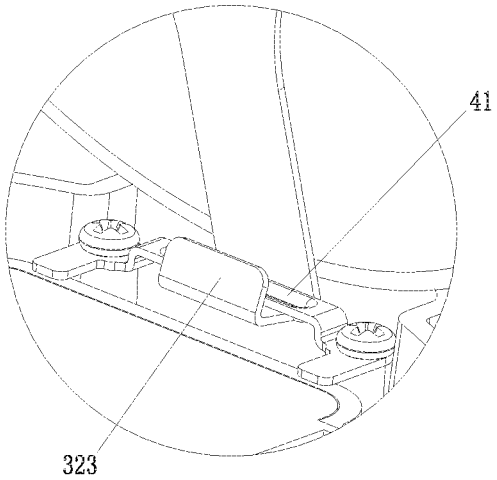
FIG. 5 is an enlarged view of part A in FIG. 4.

The mounting process of the lamp is as follows: the mounting portion 31 is coordinated with the mounting portion 31 as shown in FIG. 3, such that a notch 322 on the inner side of a guide ring 321 is aligned to the claw portion 311 on the right; the guide ring 321 is inserted into the guide groove so that the mounting portion 31 is rotatably connected to the placement portion 32; then, the placement portion 32 is clockwise rotated to the position as shown in FIG. 2, or rotated to other suitable position; the junction box 1 is mounted on a wall (not shown); the mounting portion 31 is mounted on the junction box 1 by screws 2 (as shown in FIG. 1); as shown in FIG. 4 and FIG. 5, a cross beam 41 (serving as a hooked portion) inside the lamp body 4 is aligned to a hook 323 at an end of the mounting portion 32, so that the hook 323 can hook the lamp body 4 by the cross beam 41, and in this state, the lamp is hung and the wires (not shown) connected between the lamp body and the mounting position are not shielded so that the mounting personnel can connect the leads between the lamp body 4 and the junction box 1 by both hands; and when the wires are connected, the lamp body 4 is rotated upward around the cross beam 41 to the junction box 1 (as shown in FIG. 6), and the mounting of the lamp body 4 and the junction box is completed by threaded connection. When the lamp is well mounted, the wires are shielded by the lamp body 4 and the junction box 1, which beautifies the product.

Finally, it should be noted that the embodiments above are merely provided for explaining the technical solution of the present application and not for limiting the protection scope of the present application. Although the present application has been described in detail by preferred embodiments, it should be understood by a person of ordinary skill in the art that the technical solution of the present application can be modified or equivalently replaced without departing from the essence and scope of the technical solution of the present application.

What claimed is:

1. A lamp, comprising a lamp body and a transition member which is configured to mount the lamp body in a mounting position, wherein, the transition member comprises a mounting portion and a placement portion which are rotatably connected together; the mounting portion is configured to be mounted in said mounting position; and the placement portion enables the lamp body to be placed thereon before the mounting is completed, and in this state, the wires connected between the lamp body and the mounting position are not shielded so that it is possible to connect the wires.

2. The lamp according to claim 1, wherein, by the coordination of a guide ring and a segmented guide groove, the mounting portion and the placement portion are rotatably connected; and a notch is provided on the guide ring, by which the guide ring is inserted into the guide groove from one of the segmented guide groove.

3. The lamp according to claim 2, wherein said guide ring is arranged in the placement portion; and said guide groove is arranged in the mounting portion.

4. The lamp according to claim 1, wherein, the placement portion is provided with a hook by which the lamp body is hooked before the mounting is completed; and the lamp body is provided with a hooked portion which is hooked by the hook.

5. The lamp according to claim 4, wherein the hooked portion is a crossbeam.

6. The lamp according to claim 5, wherein, the lamp body can, when hooked, be rotated to said mounting position.

7. The lamp according to claim 1, wherein, when the mounting is completed, the wires connected between the lamp body and the mounting position are shielded so that it is impossible to connect the wires.

8. The lamp according to any one of claim 1 or 2 to 7, comprising a junction box; and the lamp body is arranged on the junction box, that is, a corresponding position on the junction box is said mounting position.

9. A transition member for mounting a lamp, wherein, being the transition member in the lamp according to any one of claim 1 or 2 to 5.

10. A lamp body, wherein, being the lamp body in the lamp according to any one of claims 5 to 7.

11. A junction box assembly, comprising the junction box and the transition member in the lamp according to claim 8.

* * * * *